US011272780B2

(12) United States Patent
Asano

(10) Patent No.: US 11,272,780 B2
(45) Date of Patent: Mar. 15, 2022

(54) APPLICATION BRUSH FOR COSMETIC FORMULA

(71) Applicant: L'Oreal, Paris (FR)

(72) Inventor: Yuji Asano, Yamato (JP)

(73) Assignee: L'Oreal, Paris (FR)

( * ) Notice: Subject to any disclaimer, the term of this patent is extended or adjusted under 35 U.S.C. 154(b) by 188 days.

(21) Appl. No.: 16/622,177

(22) PCT Filed: Jun. 16, 2017

(86) PCT No.: PCT/JP2017/023112
§ 371 (c)(1),
(2) Date: Dec. 12, 2019

(87) PCT Pub. No.: WO2018/229997
PCT Pub. Date: Dec. 20, 2018

(65) Prior Publication Data
US 2020/0205559 A1 Jul. 2, 2020

(51) Int. Cl.
*A46B 5/04* (2006.01)
*A46B 5/02* (2006.01)
(Continued)

(52) U.S. Cl.
CPC ..... *A46B 5/04* (2013.01); *A45D 33/00* (2013.01); *A45D 34/042* (2013.01); *A46B 9/021* (2013.01);
(Continued)

(58) Field of Classification Search
CPC ... A46B 5/04; A46B 9/021; A46B 2200/1046; A46B 5/021; A46B 5/023; A46B 5/025; A46B 5/026
(Continued)

(56) References Cited

U.S. PATENT DOCUMENTS 6,039,051 A 3/2000 Dorf
6,513,183 B2 * 2/2003 Dorf ..... A46B 9/021 15/160
(Continued)

FOREIGN PATENT DOCUMENTS

JP 3148435 U 2/2009
JP 5274681 B 8/2013
(Continued)

OTHER PUBLICATIONS

Notice of Allowance dated Aug. 11, 2020, issued in corresponding Japanese Application No. 2019-547521, filed Jun. 16, 2017, 7 pages.
(Continued)

*Primary Examiner* — David J Walczak
(74) *Attorney, Agent, or Firm* — Christensen O'Connor Johnson Kindness PLLC

(57) ABSTRACT

An application brush for a cosmetic formula comprising: i) a base having a central axis and including a top surface that is perpendicular or substantially perpendicular to the central axis and a bottom that is spaced apart from the top surface along the central axis; and ii) a bundle of bristles that is mounted on the bottom of the base. Tips of bristles forming the bundle of bristles cooperate to define a virtual plane that is perpendicular or substantially perpendicular to the central axis, and the virtual plane has an oval shape.

5 Claims, 4 Drawing Sheets

(51) Int. Cl.

| | |
|---|---|
| ***A46B 9/02*** | (2006.01) |
| ***A45D 33/00*** | (2006.01) |
| ***A45D 34/02*** | (2006.01) |
| ***A45D 34/04*** | (2006.01) |

(52) U.S. Cl.
CPC ..... *A46B 5/021* (2013.01); *A46B 2200/1046* (2013.01)

(58) Field of Classification Search
USPC ..... D4/127, 129, 135, 138; 15/159.1, 171, 15/184, 207.2; 401/6, 88, 268, 290, 401/188 R
See application file for complete search history.

(56) References Cited

U.S. PATENT DOCUMENTS

| | | | | |
|---|---|---|---|---|
| D475,493 | S | 6/2003 | Barsamian | |
| D495,146 | S * | 8/2004 | Berti | D28/63 |
| D501,324 | S * | 2/2005 | Berti | D4/138 |
| D575,518 | S * | 8/2008 | Libman | D4/129 |
| D757,442 | S * | 5/2016 | Waitesmith | D4/127 |
| 2005/0011030 | A1 | 1/2005 | Gonzalez | |

FOREIGN PATENT DOCUMENTS

| | | | |
|---|---|---|---|
| JP | 2015-008856 | A | 1/2015 |
| JP | 3209555 | U | 3/2017 |
| JP | 1586134 | S | 9/2017 |
| KR | 10-101273723 | B1 | 6/2013 |
| KR | 10-2015-0040442 | A | 4/2015 |

OTHER PUBLICATIONS

Notice of Reasons for Rejection dated May 11, 2020, issued in corresponding Japanese Application No. 2019-547521, filed Jun. 16, 2017, 5 pages.
International Search Report dated Mar. 14, 2018, issued in corresponding International Application Mo. PCT/JP2017/023112, filed Jun. 16, 2017, 2 pages.
Decision to Grant dated Aug. 12, 2021, issued in related Korean Patent Application No. 10-2019-7036578, filed Dec. 18, 2019, 6 pages.

* cited by examiner

APPLICATION BRUSH FOR COSMETIC FORMULA

TECHNICAL FIELD

The present invention relates to an application brush used by a user to apply a cosmetic formula, such as a fluid foundation, to the face of the user, for example.

BACKGROUND ART

Users of a foundation usually apply it to their face with a finger, a puff, a sponge or a brush, for example. When a perfect make-up finish is desired, a plurality of kinds of brushes, such as a wide brush and a narrow brush, are used in many cases. For example, in order to quickly and uniformly apply a foundation to a large application target area, such as the cheeks and the chin, a wide brush having a width of about 27 mm is used. On the other hand, in order to precisely and gently apply the foundation to a small application target area, such as surroundings of the eyes and the nose, a narrow brush having a width of about 10 mm is used.

Accordingly, there is a demand for a single brush that serves as both a wide brush and a narrow brush and can be used for both a large application target area and a small application target area.

DISCLOSURE OF INVENTION

An object of the present invention is to provide a novel application brush for a cosmetic formula. In particular, an object of the present invention is to provide a novel application brush that can apply a cosmetic formula to both a large application target area and a small application target area so as to provide a more beautiful make-up finish.

To attain the object described above, the present invention provides an application brush for a cosmetic formula, comprising: i) a base having a central axis and including a top surface that is perpendicular or substantially perpendicular to the central axis and a bottom that is spaced apart from the top surface along the central axis; and ii) a bundle of bristles that is mounted on the bottom of the base, wherein tips of bristles forming the bundle of bristles cooperate to define a virtual plane that is perpendicular or substantially perpendicular to the central axis, and the virtual plane has an oval shape.

The application brush according to the present invention can serve as both a wide brush and a narrow brush, since the tips of the bristles of the bundle of bristles cooperate to define an oval virtual plane. For example, to apply a cosmetic formula to a small application target area, such as surroundings of the eyes or the nose, an end region of the oval virtual plane, that is, an end region of the oval virtual plane that intersects with the major axis of the oval, can be used. In this way, the cosmetic formula can be precisely and gently applied to the small application target area. On the other hand, for example, to apply the cosmetic formula to a large application target area, such as the cheeks or the chin, a central region or the whole of the oval virtual plane can be used. In this way, the cosmetic formula can be uniformly and quickly applied to the large application target area. In addition, the application brush according to the present invention differs from conventional application brushes in that the former allows "point application" of the cosmetic formula, rather than "line application" that tends to leave streaks. Thus, the application brush can provide a more beautiful make-up finish without streaks.

According to a preferred embodiment of the present invention, the bundle of bristles generally has the shape of an oval frustum, and the area of a cross section of the oval frustum that is parallel with the virtual plane increases toward the virtual plane.

According to a preferred embodiment of the present invention, the top surface of the base has a hexagonal shape, the bottom of the base has an oval shape, the top surface lies within a contour line of the bottom when viewed from the direction of the central axis, and the top surface and the bottom are connected to each other by first to sixth side surfaces that are connected in a ring around the central axis. In particular, according to a preferred embodiment of the present invention, the first and fourth side surfaces opposed to each other are positioned to intersect with a major axis of the oval virtual plane of the bundle of bristles, and the areas of the first and fourth side surfaces are smaller than the areas of the second and fifth side surfaces opposed to each other and than the areas of the third and sixth side surfaces opposed to each other. Thus, the user can hold the base of the application brush in at least two ways: the user can hold the base only at the second, third, fifth and sixth side surfaces having the larger area or at the first (or fourth) side surface having the smaller area and the second and sixth (or third and fifth) side surfaces on the opposite sides of the first (or fourth) side surface. The way in which the user holds the application brush can be chosen according to the part to which the cosmetic formula is to be applied, and this improves the usability of the application brush.

According to a preferred embodiment of the present invention, when the application brush is placed on a horizontal surface in such a manner that the first side surface or the fourth side surface is in contact with the horizontal surface, the center of gravity of the application brush lies within a region corresponding to the first side surface or the fourth side surface and above the region. Thus, the application brush can be placed on a horizontal surface, such as a surface of a table, in an inclined position in such a manner that the bundle of bristles does not come into contact with the horizontal surface.

According to a preferred embodiment of the present invention, at least one of the first to sixth side surfaces, or preferably all of the side surfaces, is provided with a recess that receives a fingertip of the user. Thus, the user can more reliably hold the application brush.

BRIEF DESCRIPTION OF THE DRAWINGS

Non-limiting and representative embodiment of the present invention will now be explained in detail below referring to the attached drawings.

BEST MODE FOR CARRYING OUT THE INVENTION

With reference to FIGS. 1 to 7, an application brush according to an embodiment of the present invention will be described. Without limitation, the application brush described below is intended to be used for applying a cosmetic formula, such as a fluid foundation, to the face of a user.

Figure 1:
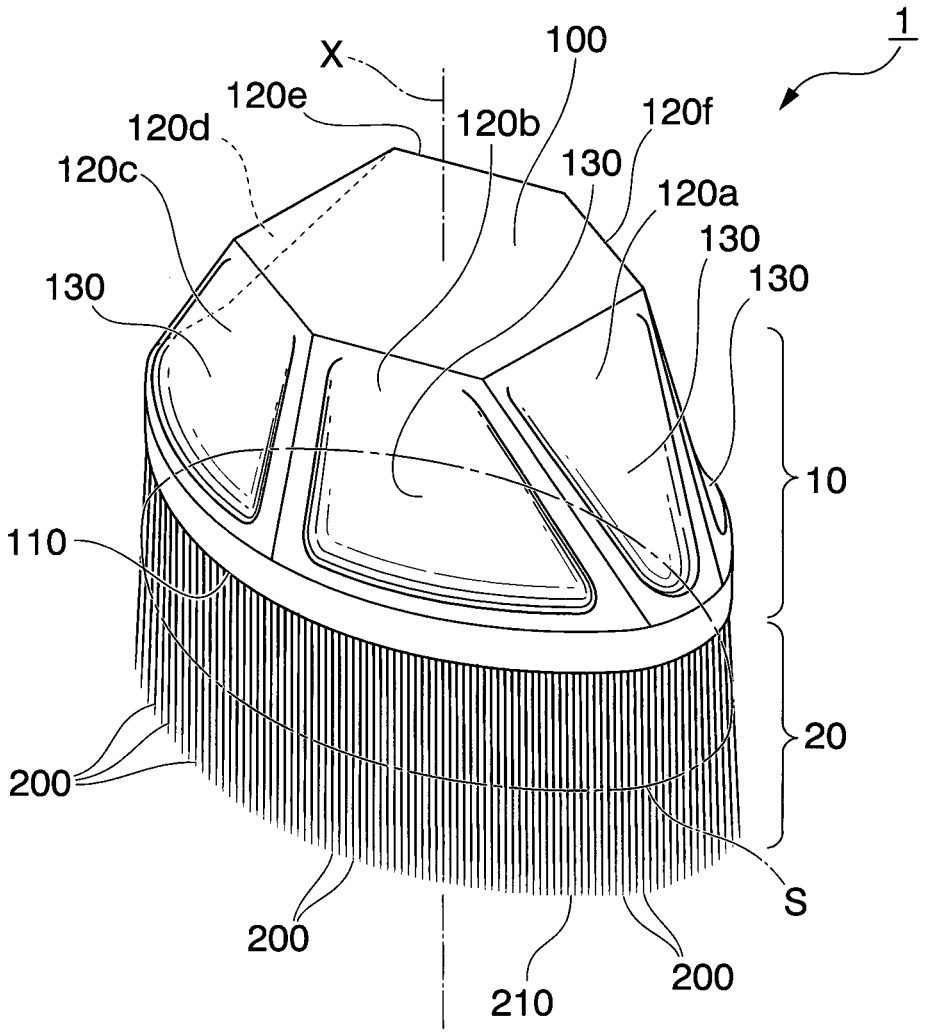
FIG. 1 is a perspective view of an application brush according to an embodiment of the present invention.

As can be seen from FIG. 1, the application brush denoted by reference numeral 1 in the drawings includes a base 10 that serves as a grip during use of the application brush and a bundle of bristles 20 fixedly mounted on the base 10.

The base 10 has a central axis X and includes a top surface 100 that is perpendicular to the central axis X and a bottom 110 that is spaced apart from the top surface 100 along the central axis X and positioned in parallel with the top surface 100. The bundle of bristles 20 is mounted on the bottom 110. The base 10 further includes first to sixth side surfaces 120*a* to 120*f*, which connect the top surface 100 and the bottom 110 to each other. Although not specifically shown in the drawings, according to this embodiment, the base 10 is composed of an inner part in which the roots of the bristles of the bundle of bristles 20 are implanted and an outer part, referred to also as a cover, that houses the inner part. According to another embodiment, the top surface 100 may be inclined with respect to the central axis X to some extent.

Figure 2:
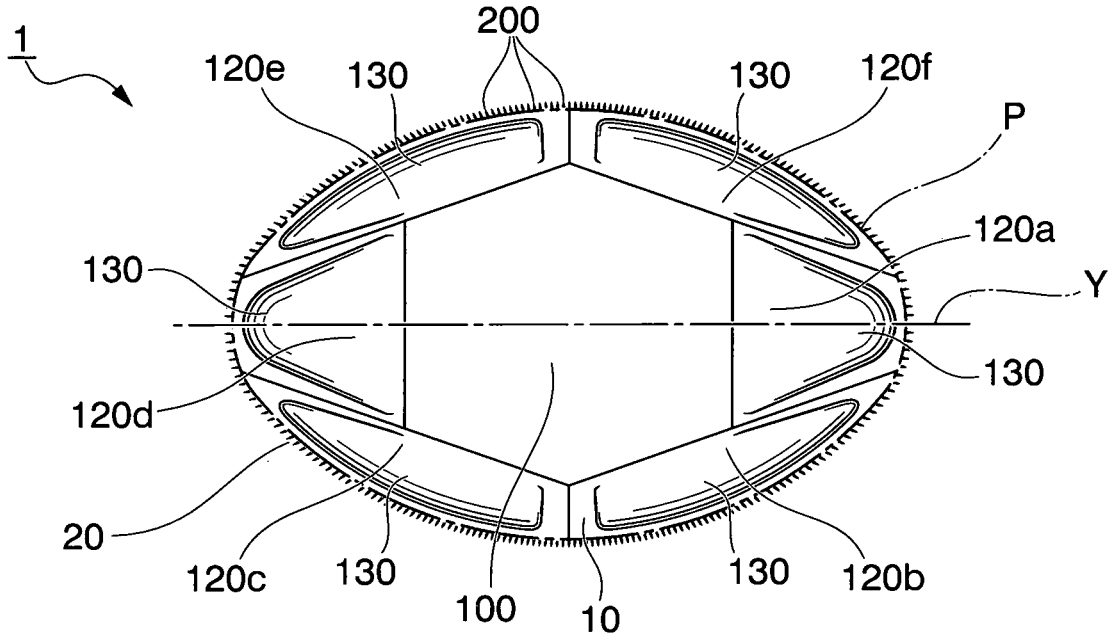
FIG. 2 is a plan view of the application brush shown in FIG. 1.

As can be seen from FIG. 2, the top surface 100 of the base 10 has a hexagonal shape, while the bottom 110 of the base 10 has an oval shape. Viewed from the direction of the central axis X, the top surface 100 lies within the contour line P of the bottom 110. Furthermore, the first to sixth side surfaces 120*a* to 120*f* extending from the six sides of the top surface 100 are connected in a circle around the central axis X. As a result, the base 10 excluding a part thereof close to the bottom 110 has the shape of a truncated hexagonal pyramid that tapers from the bottom 110 toward the top surface 100.

More specifically, the first and fourth side surfaces 120*a* and 120*d* opposed to each other are disposed to intersect with a major axis Y (see FIGS. 2 and 3) of a virtual plane 210 of the bundle of bristles 20 described later. The areas of the first and fourth side surfaces 120*a* and 120*d* are smaller than the areas of the second and fifth side surfaces 120*b* and 120*e* opposed to each other. Similarly, the areas of the first and fourth side surfaces 120*a* and 120*d* are smaller than the areas of the third and sixth side surfaces 120*c* and 120*f* opposed to each other.

According to this embodiment, all of the first to sixth side surfaces 120*a* to 120*f* have a recess 130. The recess 130 is intended to receive a fingertip of the user. Thus, the base 10 serves as a "finger fitting grip".

The bundle of bristles 20 is formed by bundling a large number of soft and delicate bristles 200, such as synthetic fibers, with an ultra-high density. The bundle of bristles 20 is mounted on the bottom 110 of the base 10, or more strictly, on the inner part described above in an appropriate manner.

The tips of the bristles 200 forming the bundle of bristles 20 cooperate to define the virtual plane 210 that is perpendicular to the central axis X. As can be seen from FIG. 3, the virtual plane 210 has the shape of an oval having the major axis Y. According to another embodiment, the virtual plane 210 may be inclined with respect to the central axis X to some extent.

Figure 4:
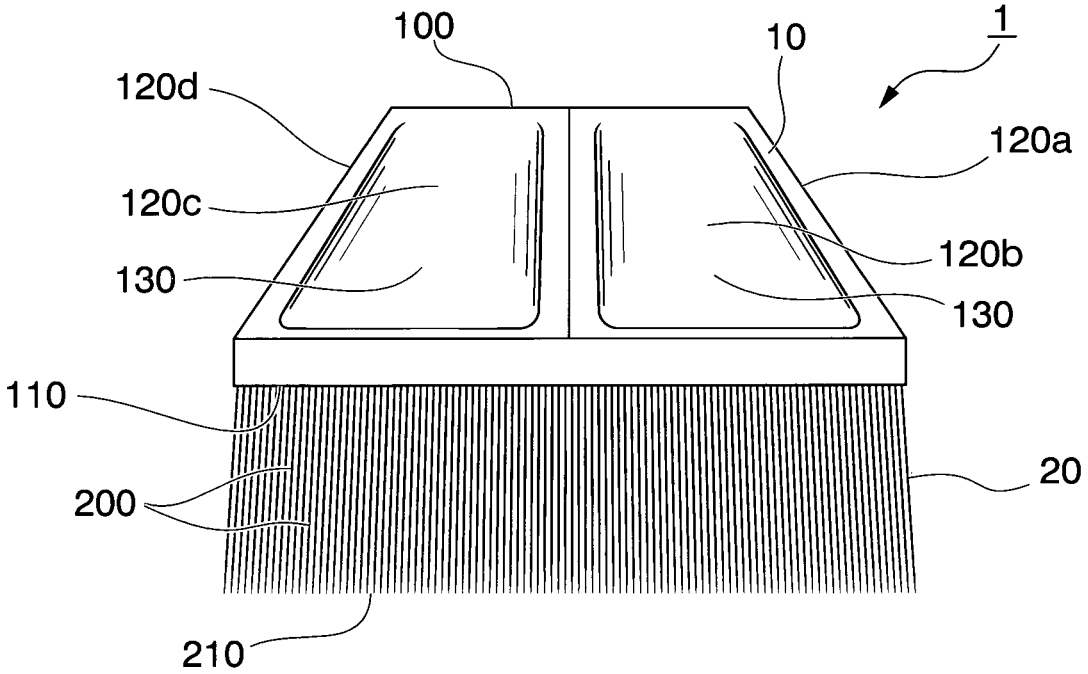
FIG. 4 is a side view of the application brush shown in FIG. 1.

As can be seen from FIGS. 1 and 2 as well as FIG. 4, the bundle of bristles 20 has the shape of an oval frustum. The area of a cross section (denoted by S in FIG. 1) of the oval frustum that is parallel with the virtual plane 210 increases toward the virtual plane 210 from the bottom 110 of the base 10. According to another embodiment, the area of the cross section of the bundle of bristles 20 may be constant.

Figure 3:
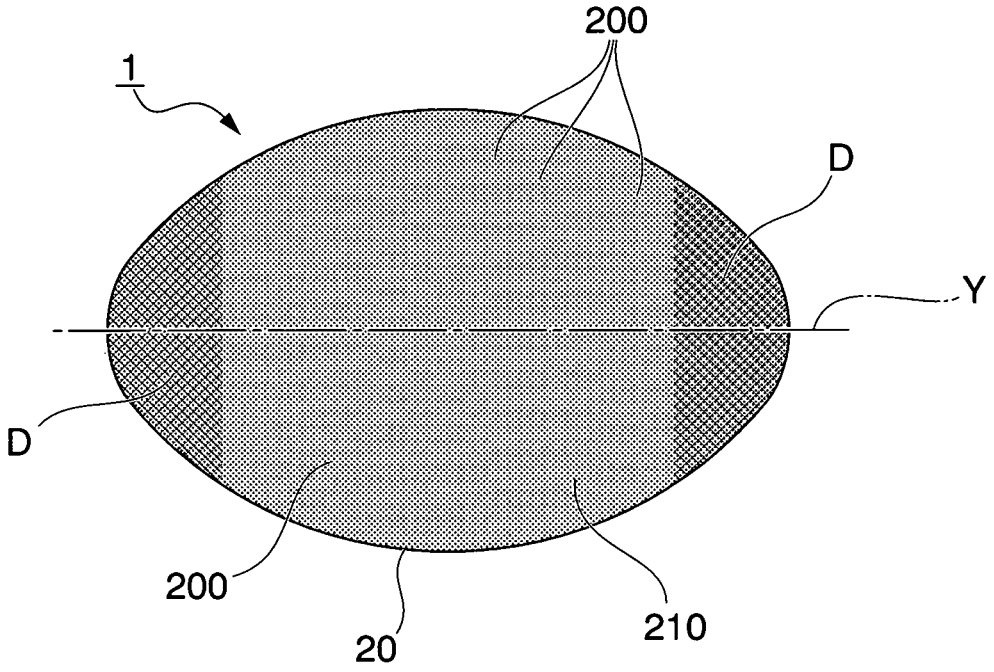
FIG. 3 is a bottom view of the application brush shown in FIG. 1.

The end regions D of the virtual plane 210 intersecting with the major axis Y of the virtual plane 210, which are crosshatched in FIG. 3, can be used for applying a foundation to a small application target area, such as surroundings of the eyes or the nose, in particular. On the other hand, the remaining central region or the whole of the virtual plane 210 of the bundle of bristles 20 can be used for applying the foundation to a large application target area, such as the cheeks or the chin.

Figure 5:
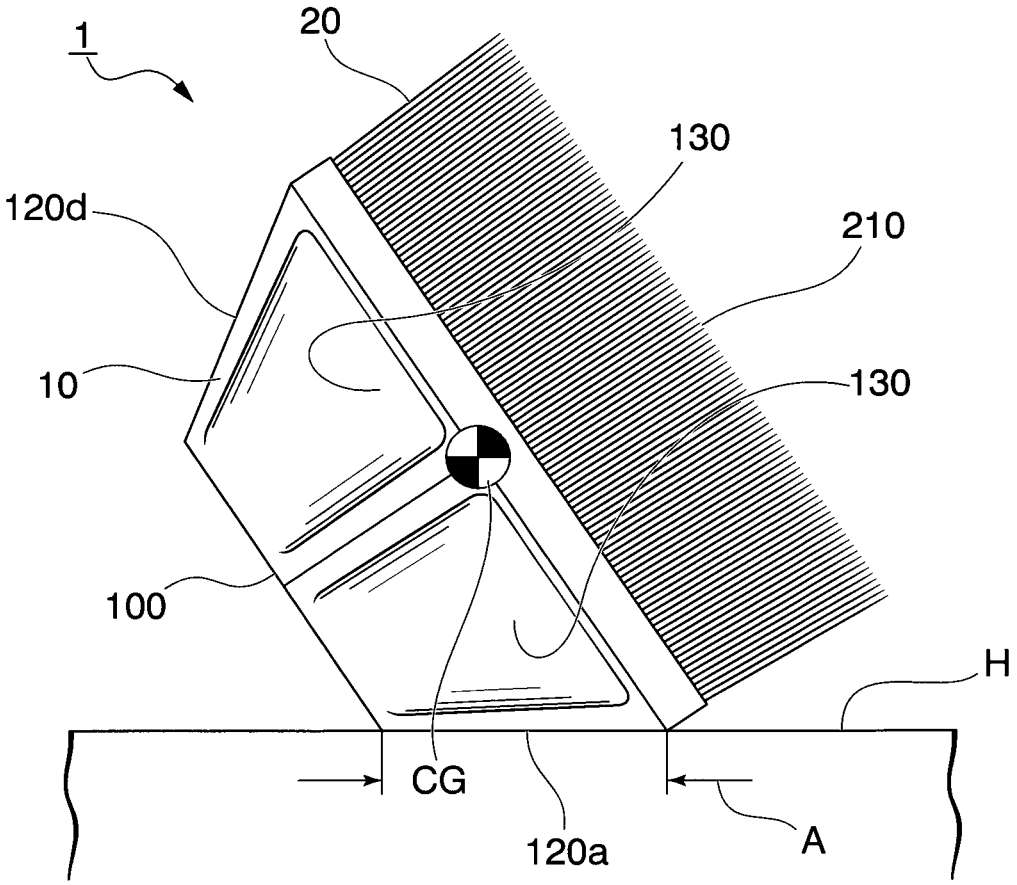
FIG. 5 shows the application brush shown in FIG. 1 placed on a horizontal surface in an inclined position.

FIG. 5 shows the application brush 1 that is placed on a horizontal surface H, such as a surface of a table, in such a manner that the first side surface 120*a* is in contact with the horizontal surface H. The application brush 1 is configured so that, in this state, the center of gravity CG thereof lies within a region A corresponding to the first side surface 120*a* that is in contact with the horizontal surface H and above the region A. Thus, the application brush 1 can stay inclined on the horizontal surface H. The same holds true for the fourth side surface 120*d*. Since the application brush 1 is configured in this way, when the application brush 1 is cleaned after use, the application brush 1 can be placed on a horizontal surface, such as a surface of a table, in such a manner that the bundle of bristles 20 does not come into contact with the horizontal surface. This facilitates quick drying of the brush 1. In addition, the application brush 1 placed on the horizontal surface in this way can be easily picked up by the user.

Figure 6:
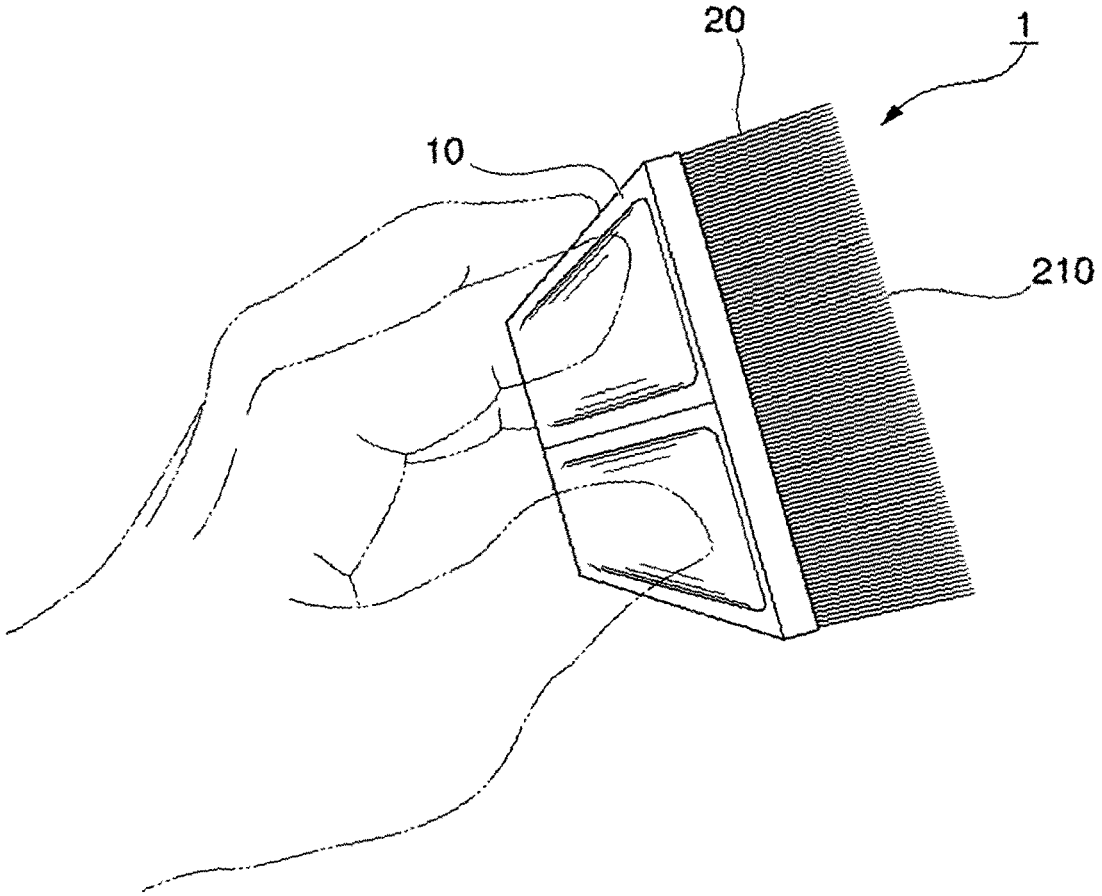
FIGS. 6 and 7 show the application brush shown in FIG. 1 held in a hand of a user.

Application of a cosmetic formula, such as a fluid foundation, with the application brush 1 described above is performed as described below, for example. To apply the cosmetic formula to a large area, such as the cheeks, the chin, the forehead or the neck of the user, the bristles of the bundle of bristles 20 in the whole or the central region of the virtual plane 210 are used as described above. In this case, as shown in FIG. 6, the user holds the base 10 of the application brush 1 with all or four, including the thumb, of the fingers of the user, for example. In this way, the cosmetic formula can be uniformly and quickly applied.

Figure 7:
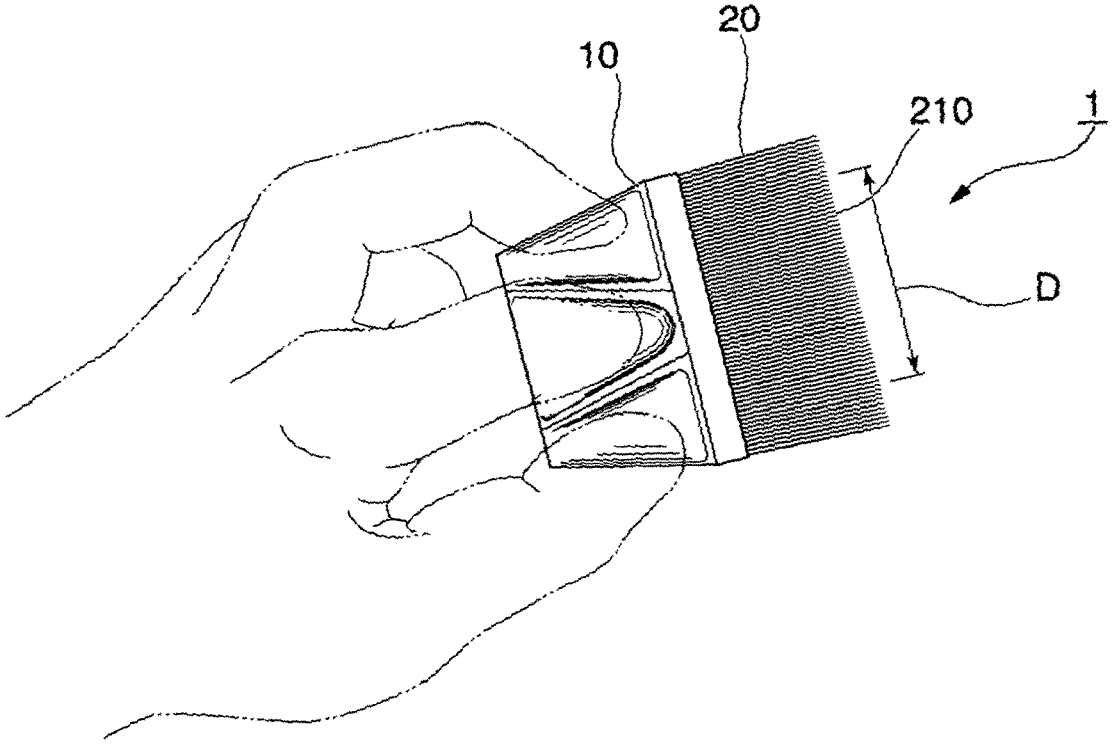

On the other hand, to apply the cosmetic formula to a small area, such as surroundings of the eyes or the nose, the bristles of the bundle of bristles 20 in the end regions D of the virtual plane 210 are used as described above. In this case, as shown in FIG. 7, the user holds the base 10 of the application brush 1 with three of the fingers of the user, the thumb, the index finger and the middle finger, for example. In this way, the cosmetic formula can be precisely and gently applied.

Preferred embodiments of the present invention have been explained above with reference to the drawings. However, the present invention is not limited to these embodiments, and various modifications and changes may be made to the above-described embodiments without deviating from the gist and scope of the present invention, and such modifications and changes are included in the scope of the present invention.

The invention claimed is:

1. An application brush for a cosmetic formula, comprising:

a base having a central axis and including a top surface that is perpendicular to the central axis and a bottom that is spaced apart from the top surface along the central axis, wherein the top surface of the base has a hexagonal shape, and the bottom of the base has an oval shape, the top surface lies within a contour line of the bottom when viewed from the direction of the central axis, and the top surface and the bottom are connected to each other by first to sixth side surfaces that are connected in a ring around the central axis; and a bundle of bristles that is mounted on the bottom of the base, wherein tips of bristles forming the bundle of bristles cooperate to define a virtual plane that is perpendicular to the central axis, and the virtual plane has an oval shape.

2. The application brush according to claim 1, wherein the bundle of bristles has the shape of an oval frustum, and an area of a cross section of the oval frustum that is parallel with the virtual plane increases toward the virtual plane.

3. The application brush according to claim 1, wherein the first and fourth side surfaces opposed to each other are positioned to intersect with a major axis of the virtual plane of the bundle of bristles, and the areas of the first and fourth side surfaces are smaller than the areas of the second and fifth side surfaces opposed to each other and than the areas of the third and sixth side surfaces opposed to each other.

4. The application brush according to claim 1, wherein when the application brush is placed on a horizontal surface in such a manner that the first side surface or the fourth side surface is in contact with the horizontal surface, the center of gravity of the application brush lies within a region corresponding to the first side surface or the fourth side surface and above the region.

5. The application brush according to claim 1, wherein at least one of the first to sixth side surfaces is provided with a recess.

* * * * *